US007179003B2

(12) United States Patent
Boulogne et al.

(10) Patent No.: US 7,179,003 B2
(45) Date of Patent: Feb. 20, 2007

(54) LIPSTICK MECHANISM

(75) Inventors: Bernard Boulogne, Metz-Tessy (FR); Claude Susini, La Croix Léonard, "Vers", F-71240 Sennecey-le-Grand (FR)

(73) Assignees: Rexam Reboul (FR); Claude Susini (FR)

( * ) Notice: Subject to any disclaimer, the term of this patent is extended or adjusted under 35 U.S.C. 154(b) by 0 days.

(21) Appl. No.: 11/116,921

(22) Filed: Apr. 28, 2005
(Under 37 CFR 1.47)

(65) Prior Publication Data

US 2005/0286964 A1 Dec. 29, 2005

Related U.S. Application Data

(63) Continuation of application No. PCT/EP2003/012021, filed on Oct. 29, 2003.

(30) Foreign Application Priority Data

Oct. 30, 2002 (FR) ..... 0213591

(51) Int. Cl.
*B43K 21/00* (2006.01)

(52) U.S. Cl. ..... 401/80

(58) Field of Classification Search ..... 401/55, 401/68, 72, 74, 80, 84
See application file for complete search history.

(56) References Cited

U.S. PATENT DOCUMENTS 5,096,318 A * 3/1992 Susini et al. ..... 401/80
6,126,351 A 10/2000 Gueret

FOREIGN PATENT DOCUMENTS

EP 0 554 974 A1 8/1993
GB 1118889 A 7/1968

* cited by examiner

*Primary Examiner*—Huyen Le
(74) *Attorney, Agent, or Firm*—DLA Piper US LLP

(57) ABSTRACT

A lipstick mechanism including an internal substantially tubular duct that rotates in an external substantially tubular duct, the ducts having longitudinal slots and helical slots that guide in translation studs of a lipstick-holder cup disposed in the internal tubular duct, the internal duct including a substantially cylindrical base with a restriction relief that bears elastically on a substantially cylindrical surface connected to the external duct, such that the surface connected to the external duct is elastically deformable and the restriction relief is formed by a raised area sunk in the surface.

10 Claims, 3 Drawing Sheets

LIPSTICK MECHANISM

RELATED APPLICATION

This is a continuation of International Application No. PCT/EP2003/012021, with an international filing date of Oct. 29, 2003 (WO 2004/039203 A1, published May 13, 2004), which is based on French Patent Application No. 02/13591, filed Oct. 30, 2002.

FIELD OF THE INVENTION

This invention concerns a lipstick mechanism in which braking is provided by relief section of an inner sleeve.

BACKGROUND

EP 0 439 381 discloses a mechanism provided with such a restriction device, is which the relief consists of elastic lugs formed by a ring attached to the base of the duct, or even formed directly on the base of the duct. These lugs or tongues are disposed parallel to the axis of the duct and separate radially outwards to bear on the internal wall of the external duct at its base, or on a wall connected to this duct (possibly the decorative sheath which surrounds the external duct). This mechanism offers restriction which gives complete satisfaction. However, this excellent quality has a manufacturing cost which may be too high for mass production, less demanding in terms of quality.

It has been sought to produce restriction tongues directly in the wall of the cylindrical base to reduce manufacturing costs by virtue of a single injection molding operation. The restriction reliefs then consist of shoes or buttons disposed on a wall part, thinned or not, formed in the wall of the cylindrical base and cut (by molding) to form the tongue. That structure is shown, with various forms of tongues, for example, in U.S. Pat. Nos. 5,186,560, 5,186,561 and 5,324,126.

However, the quality of these mechanisms is low, especially for mass production.

It would therefore be advantageous to provide a restriction mechanism which achieves the same quality as that in EP 0 439 381, but is lower in cost.

SUMMARY OF THE INVENTION

This invention relates to a lipstick mechanism including an internal substantially tubular duct that rotates in an external substantially tubular duct, the ducts having longitudinal slots and helical slots that guide in translation studs of a lipstick-holder cup disposed in the internal tubular duct, the internal duct including a substantially cylindrical base with a restriction relief that bears elastically on a substantially cylindrical surface connected to the external duct, such that the surface connected to the external duct is elastically deformable and the restriction relief is formed by a raised area sunk in the surface.

BRIEF DESCRIPTION OF THE DRAWINGS

Other advantages and characteristics of the invention will emerge from a reading of the following description, with reference to the accompanying drawings, in which.

DETAILED DESCRIPTION

Figure 1:
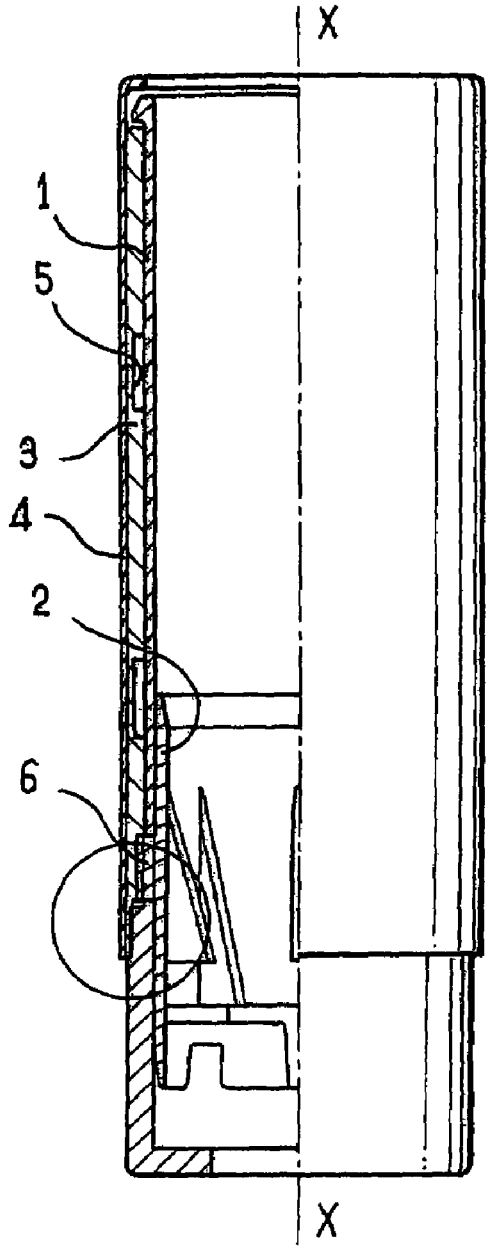
FIG. 1 is a half side view and a half view in section of a lipstick mechanism according to aspects of the invention.

It will be appreciated that the following description is intended to refer to specific embodiments of the invention selected for illustration in the drawings and is not intended to define or limit the invention, other than in the appended claims.

This invention relates to a lipstick mechanism comprising an internal tubular duct intended to turn in an external tubular duct, the ducts having two longitudinal slots and two helical slots for guiding in translation the studs on a stick-holder cup disposed in the internal tubular duct, the internal duct comprising a cylindrical base with a restriction relief that bears elastically on a substantially cylindrical surface connected to the external duct, characterized in that the surface connected to the external duct is elastically deformable and that the restriction relief comprises a raised area sunk in the surface.

"Raised area" means an area where the distance to the axis of rotation is greater than the external radius of the part without relief of the cylindrical base of the internal duct. This height is even here greater than the nominal internal radius of the surface of the external sheath, which causes the aforementioned sinking, the sinking being considered not only sinking within the wall itself, but as a localized deformation of the wall with respect to its natural position. The elasticity of the restriction is therefore given by the elasticity of the deformation of the wall constituting the surface, rather than by restriction lugs. This simplifies manufacture and eliminates a part of the prior mechanism, namely the collar of elastic lugs.

In a particularly advantageous manner, the restriction relief concerns a substantial angular sector of the internal duct (or of the surface) to offer a fairly wide surface which makes it possible to reduce the pressure necessary for restriction and making it possible to limit the sinking to a very low value. The relief is preferably in the form of a cylindrical raised area and its extension sector is between about 70° and about 100° and preferably between about 80° and about 90°.

According to one aspect, the restriction relief comprises a simple off-centring of the cylindrical part of the internal duct, at the restriction surface.

If the wall constituting the surface is covered with a cylindrical rigid envelope, such as the sheath of the mechanism, it is associated externally with a space allowing its deformation, this base being able to be formed at least partially by a thinning of the envelope or by a thinning of the wall constituting the surface, the latter possibility being particularly compatible with the requirement to make the wall deformable. Naturally it is also possible not to have a cylindrical envelope at all at this level, for example, by making provision for producing a shorter sheath.

The mechanism is advantageously produced from one or more injected plastics materials. The internal duct can be manufactured from many plastic materials traditionally used for this type of injection, according to the quality and cost price required. Account is also taken of the applications sought: it is known that, according to certain formulations used for the lipsticks and the solvents which are released therefrom, certain materials are advisable over others. For example, certain solvents react with styrene resin such as polystyrene and others cause swelling of the polypropylene which is prejudicial to the maintenance over time of the restriction qualities of the mechanism of the invention, since these qualities relate essentially to relatively precise clearances provided between all the constituent parts. For the external sheath which comprises the deformable surface, it is for example advantageous to use a polyacetal resin (polyoxymethylene POM). This resin is particularly advantageous for its good shape memory and its resistance to cracking. Moreover, the polystyrene-polyacetal pair or the polypropylene-polyacetal pair offer good quality of friction.

For manufacturing the mechanism, provision is advantageously made for all the pieces (independently of the relief art of the duct) to be assembled with minimum clearance providing a very slight overall friction, imperceptible to the user but opposing the "drifting" of the pieces, the only perceptible but gentle friction being afforded by the relief part of the duct, in accordance with the invention. To ensure this minimum clearance between the pieces, and in particular between the internal duct and the external duct, it is particularly advantageous, apart from the restriction relief, for the internal and external ducts to have contact limited to narrow abutment areas, preferably situated towards their respective ends.

In practice, the internal duct is designed to be perfectly cylindrical, and the external sheath is designed with a very slight conicity, invisible to the eye, but sufficient to facilitate good stripping from the mold. The internal duct comprises at its bottom part a very thin cylindrical surface (around $1/10^{th}$ mm) sufficient to ensure the perfect coaxial holding of the external duct in abutment first on the top part of the internal duct and secondly on the surface of the bottom part of the internal duct. This abutment in two distant narrow areas considerably reduces the friction of the external duct on the internal duct. The main part of the friction is due to the cam formed by the restriction relief according to the invention. This relief can itself advantageously be provided with a certain conicity, according to the torque required. This is because this conicity makes it possible to adapt the restriction surface and therefore the pressure exerted to the required application.

Figure 5:
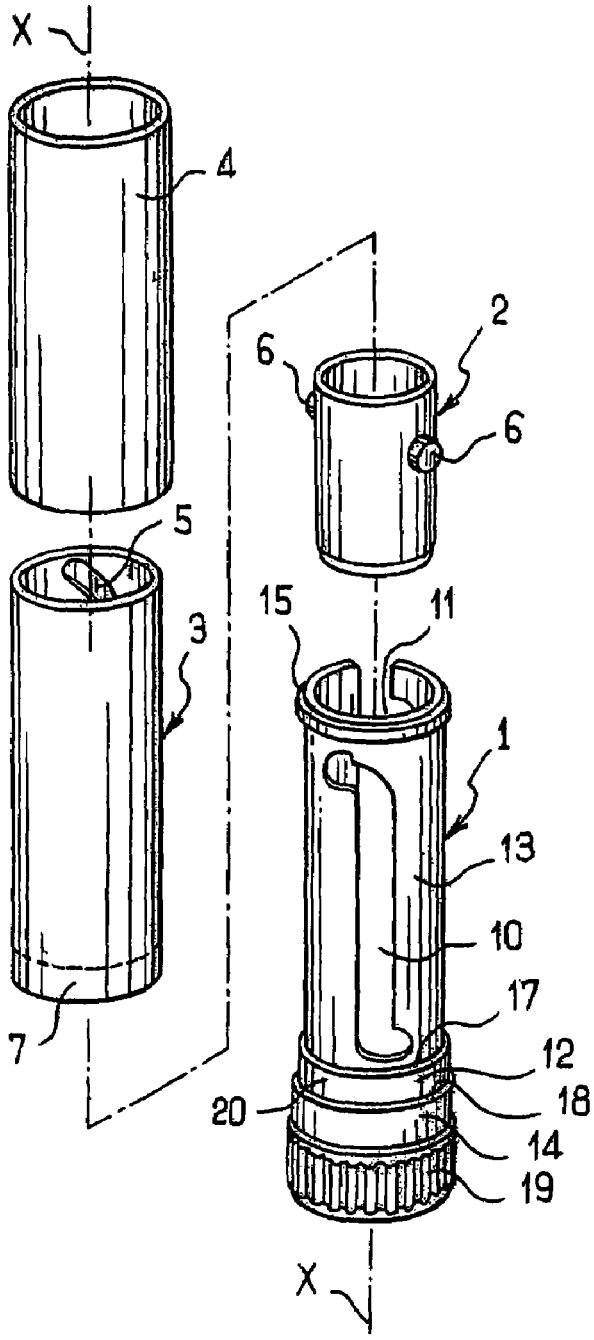
FIG. 5 is an exploded view of the various elements constituting the mechanism of FIG. 1.

A lipstick mechanism comprises conventionally (FIG. 5) a plastic cylindrical internal duct 1 receiving the lipstick-holder cup 2. The external duct or spiral 3, also made from plastic, substantially cylindrical, itself covered with a decorative sheath or body 4, generally made from metal or metallized plastic, is slipped onto the whole. These elements are mounted concentrically, in symmetry of revolution about an axis XX.

The internal duct 1 comprises two longitudinal slots 10 and 11, while the external duct 3 comprises two helical slots 5 (which may be only simple grooves in its substantially cylindrical internal face) defining with the longitudinal slots 10, 11 a crossing area where the studs 6 on the cup 2 engage, the height of this area (and therefore the position of the cup 2) depending on the relative rotation of the ducts 1 and 3.

The external duct 3 comprises at its base a substantially cylindrical area 7 which is intended to come opposite the annular base 12 of the internal duct 1 to cooperate with it to produce the gentle friction device which will be described below.

The internal duct 1 comprises three areas, respectively, from top to bottom the main area 13 on which the slots 10, 11 are formed; then the annular base area 12 on which the eccentric restriction device of the invention is formed, and finally the cap 14, which can comprise longitudinal flutes or godroons 19 on a part, preferably bottom, of its external cylindrical surface. The areas 13 and 12, as well as 12 and 14, can be separated by shoulders 17 and 18.

All these elements are know per se and do not require further explanation.

Figure 2:
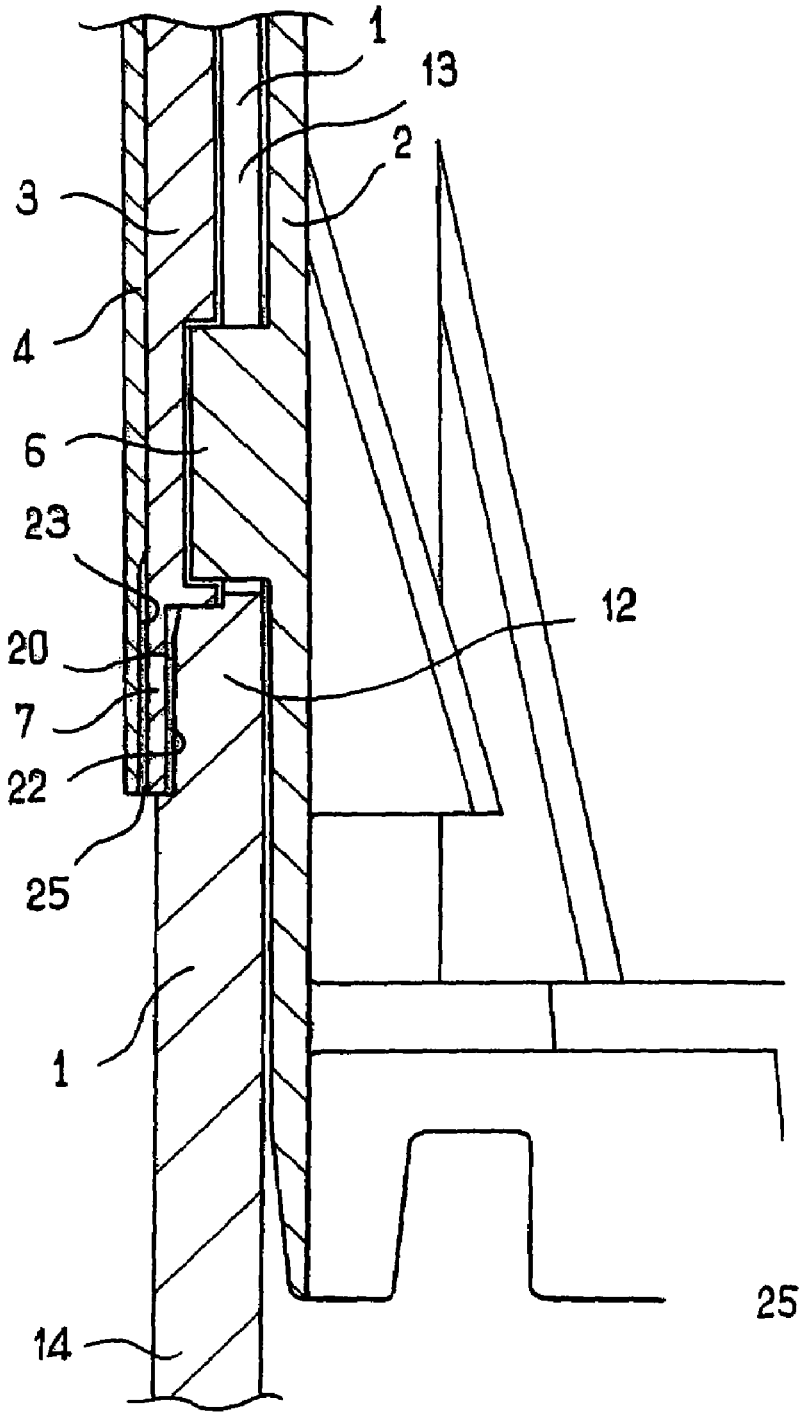
FIG. 2 is a detail view in section of the friction part of the mechanism of FIG. 1.

The annular base area 12 comprises a wall which is substantially cylindrical overall, whose internal face is in continuity with the internal faces of the area 13 or area 14 (of FIG. 2). The external face 20 of the wall 12 comprises, over a large angular sector A, a gentle restriction relief 21 intended to cooperate with the internal wall 22 of the bottom part 7 of the duct 3.

Figure 7:
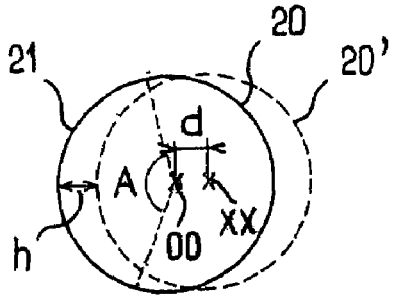
FIGS. 6 and 7 are two transverse section diagrams of the external cylindrical surface of the duct at the friction part.
Figure 6:
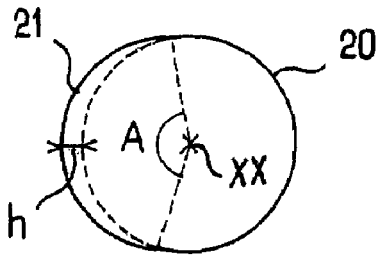

This gentle relief 21 generally comprises a cylindrical surface with a generatrix parallel to the axis XX. It may be the case, as depicted schematically in FIG. 6, of providing on the cylindrical external surface 20 of the wall 12, centered on XX, a localized protrusion in the section A, this protrusion being similar to a cam. It may also be the case, as depicted schematically in FIG. 7, of entirely off-centering the cylindrical external surface 20, 21 so that it is centered on an axis OO adjacent and parallel to XX. The off-centering d (for example of 0.2 mm) between the two axes means that the part 21 constitutes a relief with approximately the same value d at its maximum level with respect to the theoretical cylindrical surface 20' which would be centered on XX, while the opposite part of the external surface 20 will be recessed by the same clearance d with respect to the theoretical surface 20'. In both cases, a relief 21 is obtained having a maximum protrusion h with respect to the theoretical cylinder. This height h is equal to the off-centring d in the case in FIG. 7.

This part in relief 21, whether it results from a true relief or an off-centering, will therefore bear on the face 22 of the wall 7 over an angular sector A which is chosen to be sufficiently large. It is preferably between about 70° and about 100°, and more particularly between about 80° and about 90°.

Figure 3:
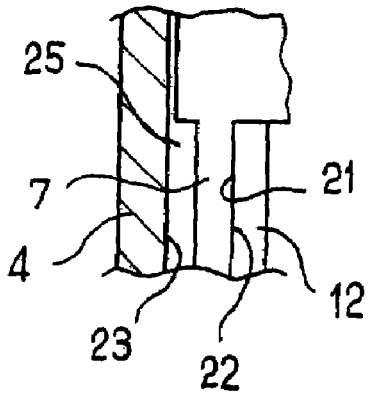
FIG. 3 is a simplified detail view in section of a variant of the friction part of the mechanism of FIG. 1.

The wall 7 is designed to be able to deform when the relief part 21 passes, by virtue of its dimensional and constituent characteristics: a given plastics material having a certain flexibility and fairly thin thickness to benefit from this flexibility. For example, in the case of a polyacetal resin, a thickness of approximately 0.5 mm can be envisaged. To allow this deformation towards the outside due to the sinking of the relief 21, the wall 7 is separated from the facing wall 23 of the body 4 by a sufficient space 25, in principle slightly greater than the maximum protrusion h of the relief 21. This space 25 can obtained either by an internal thinning of the body 4 in its bottom part (or a recessing without thinning of the body, by increasing the mean diameter of the body), as depicted in FIG. 2, or by an external thinning of the wall 7 itself as depicted in FIG. 3, or by a combination of these possibilities.

Figure 4:
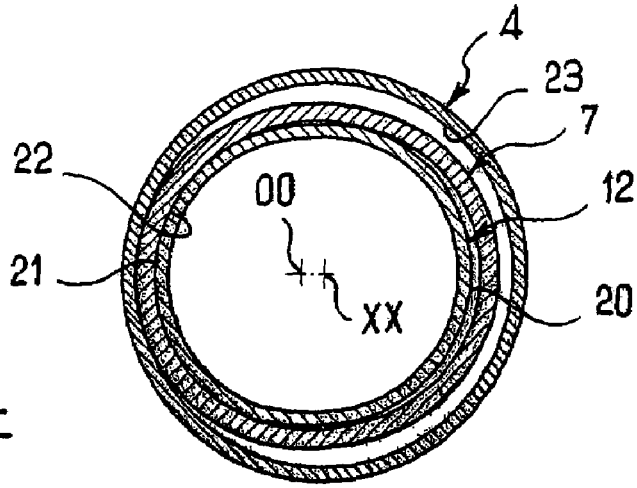
FIG. 4 is a view in transverse section of the friction part of the mechanism of FIG. 1.

FIG. 4 illustrates deformation occurring at the wall 7 of the spiral 3 and the wall 12 of the internal duct. The body 4 is rigid and remains a cylinder centred on XX. The wall 12 of the internal sheath 1, centered on OO (this is the case where the relief 21 is formed by off-centring) pushed by its part 21 against the opposite face 22 of the wall 7, which, in principle cylindrical centred on XX, is then deformed in an egg shape, and locally approaches the wall of the body 4; diametrically opposite, the part 20 of the wall 12 remains distant from the wall 7, which itself remains at a distance from the body 4.

The height in contact of the area 12 and the area 7 on which the deformation acts is about 2 to 3 mm. In this way a gentle elastic pressure is exerted on the area 12, which allows the required gentle and even rotation of the mechanism.

To make it possible for the friction to be due almost exclusively to the friction exerted by the part 21 in relief, the other natural clearances of the mechanism are reduced to a minimum. In particular, the external duct 3, described as substantially cylindrical, is preferably provided with a very slight conicity giving rise to a difference of a few hundredths of a millimeter between its smallest diameter at the top part and its widest diameter at the bottom part. Its top part bears directly on the external face of the internal duct 1, just below the rim 15, while its bottom part rests on a very thin shoulder (for example, $1/10^{th}$ of a millimeter) formed at the bottom part of the area 13 of the duct 1, just above the annular area 12. Because of this, the external duct 3 is in coaxial abutment on the internal duct 1 only at two areas formed to be almost reduced to circles, respectively, top and bottom, and the friction generated during their relative rotation is at a minimum. In addition, having regard to the slight conicity of the external sheath 3 and therefore its bottom skirt 7 and because this conicity increases with the deformation due to the restriction cam 21, it is advantageous to also provide the surface of the restriction cam 21 with a certain conicity (splaying downwards) to adapt the contact surface of this area 21 and of the bottom area 7 according to the application; the greater or lesser conicity adopted will, in relation to the other parameters such as the height and extension of the surface 21, determine the restriction force exerted.

Although this invention has been described in connection with specific forms thereof, it will be appreciated that a wide variety of equivalents may be substituted for the specified elements described herein without departing from the spirit and scope of this invention as described in the appended claims.

The invention claimed is:

1. A lipstick mechanism comprising an internal substantially tubular duct that turns in an external substantially tubular duct, the ducts having two longitudinal slots and two substantially helical slots for guiding in translation studs of a lipstick-holder cup disposed in the internal tubular duct, the internal duct comprising a substantially cylindrical base with a restriction relief that bears elastically on a substantially cylindrical surface connected to the external duct, wherein the surface connected to the external duct is elastically deformable and the restriction relief is formed by a raised area sunk in the surface and comprises off-centering a cylindrical part of the internal duct at the restriction surface, and wherein a wall constituting the surface is covered with a rigid substantially cylindrical envelope and is associated externally with a space permitting its deformation that results at least partially from a thinning of the rigid envelope.

2. The mechanism according to claim 1, wherein the restriction relief is a substantially angular sector of the internal duct.

3. The mechanism according to claim 2, wherein an angle (A) of the angular sector is between about 70° and about 100°.

4. The mechanism according to claim 2, wherein an angle (A) of the angular sector is between about 80° and about 90°.

5. The mechanism according to claim 1, wherein the space results at least partially thinning of a wall constituting the surface.

6. The mechanism according to claim 1, produced from injected plastics materials.

7. The mechanism according to claim 6, wherein the internal duct comprises styrene resin(s).

8. The mechanism according to claim 7, wherein the external duct comprises polyacetal resin(s).

9. The mechanism according to claim 6, wherein the external duct comprises polyacetal resin(s).

10. The mechanism according to claim 1, wherein, apart from the restriction relief, the internal duct and external duct have contacts limited to two narrow abutment areas.

* * * * *